US005454210A

United States Patent [19]

Piazza

[11] Patent Number: 5,454,210

[45] Date of Patent: Oct. 3, 1995

[54] MACHINE FOR BOXING GLASS AMPULS

[75] Inventor: Aldo Piazza, Alberi Di Vigatto, Italy

[73] Assignee: Advanced Machinery Co., Ltd., Dublin, Ireland

[21] Appl. No.: 67,828

[22] Filed: May 27, 1993

[30] Foreign Application Priority Data

May 27, 1992 [IT] Italy ..... MI92A1301

[51] Int. Cl.[6] ..... B65B 5/08; B65B 23/22

[52] U.S. Cl. ..... 53/448; 53/148; 53/236; 53/247; 53/251; 53/473; 53/539

[58] Field of Search ..... 53/448, 444, 443, 53/543, 539, 536, 535, 150, 148, 247, 252, 251, 250, 236, 284.6, 473

[56] References Cited

U.S. PATENT DOCUMENTS 3,302,368 2/1967 Ziche ..... 53/247 X
3,984,964 10/1976 Stoll ..... 53/543
4,056,920 11/1977 Shields ..... 53/539 X
4,644,734 2/1987 Hartness ..... 53/539 X
4,680,920 7/1987 Veré et al. ..... 53/251 X
4,932,191 6/1990 Wild ..... 53/247 X

*Primary Examiner*—James F. Coan
*Attorney, Agent, or Firm*—Cushman Darby & Cushman

[57] ABSTRACT

A machine automatically carries out operations for ampul boxing, because it includes, coordinately operating with one another, a framework, a conveyor device for conveying the ampuls, a box transporting and positioning unit, an ampul transfer device and either a pneumatic or a mechanical device for transient ampul clamping.

8 Claims, 10 Drawing Sheets

MACHINE FOR BOXING GLASS AMPULS

BACKGROUND OF THE INVENTION

The present invention relates to a machine for boxing ampules, in particular, glass ampuls intended for medical use.

Ampul-boxing machines are presently known which, however, are not capable of correctly performing the loading of the ampuls inside the interior of the box. Boxes of ampuls filled using presently available boxing machines frequently display empty places between the rows of boxed ampuls, which empty places must be manually filled by the operators. Furthermore, inside the boxes leaving such prior art machines, broken ampuls may be present, because the presently available machines are not generally capable of automatically removing broken ampuls from the loading cycle.

At present, the presence of an operator is consequently necessary, with all the consequences which such a situation may cause, not last that the operator is requested to supply a performance which depends on production rhythms of a machine and hence tendentially compulsory, continuous and tedious.

SUMMARY OF THE PRESENT INVENTION

The purpose of the present invention is to obviate the above mentioned drawbacks, i.e., provide a machine which is capable of carrying out, in an as complete as possible way, the boxing operations and, in particular, is capable of eliminating the interventions by the operator in order to complete the rows of ampuls packaged inside the boxes and removing any possibly broken ampuls. Therefore, the present operator remains responsible for a task which mainly is checking that the machine is performing according to plan.

BRIEF DESCRIPTION OF THE DRAWINGS

The invention illustrated for merely exemplifying, non-limitative purposes, in the accompanying figures, in which.

DETAILED DESCRIPTION OF PREFERRED EMBODIMENTS

Figure 1:
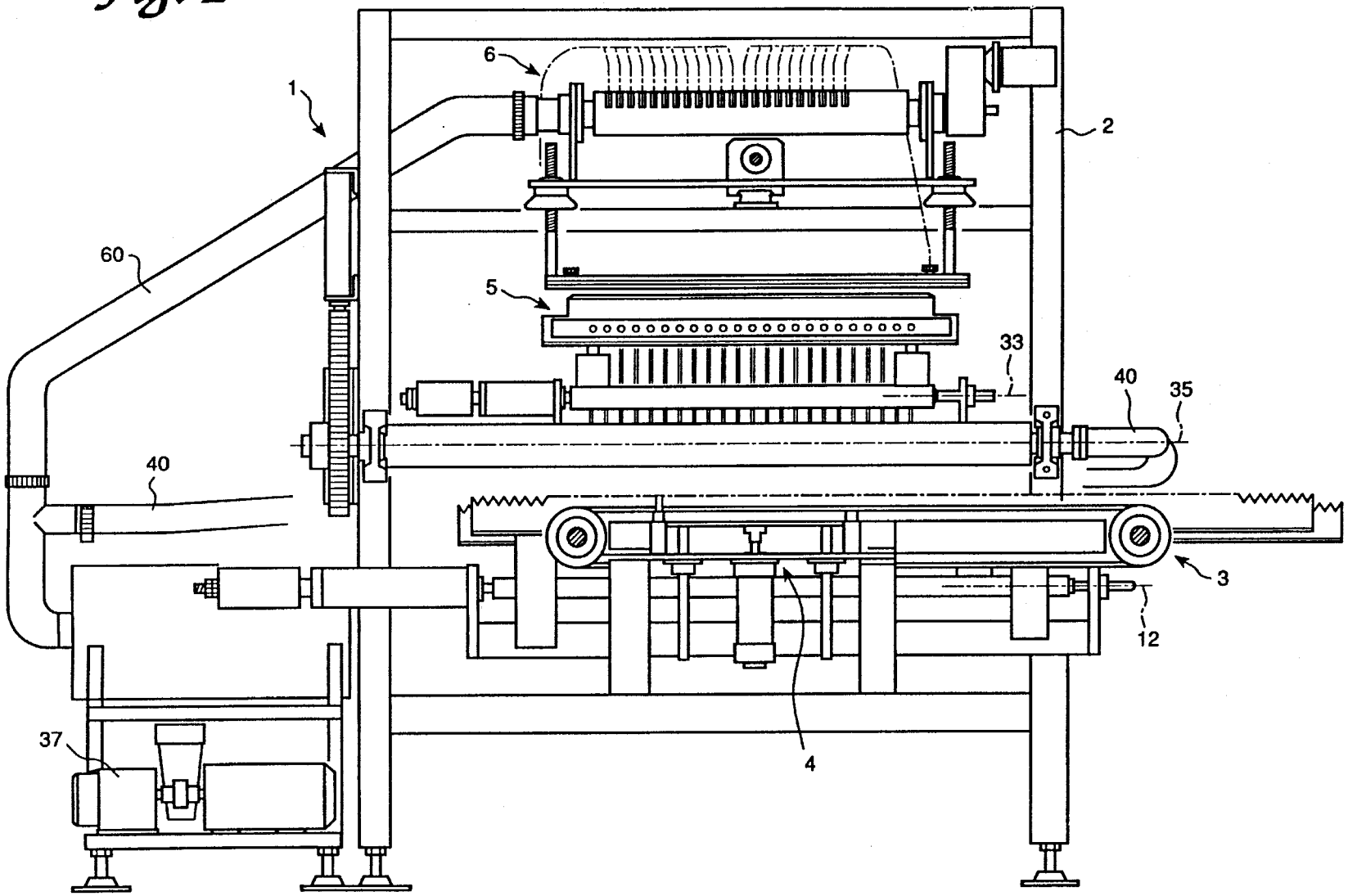
FIG. 1 is a schematic view of the machine which, with reference to the ampul advancing direction, is defined as a side view.
Figure 2:
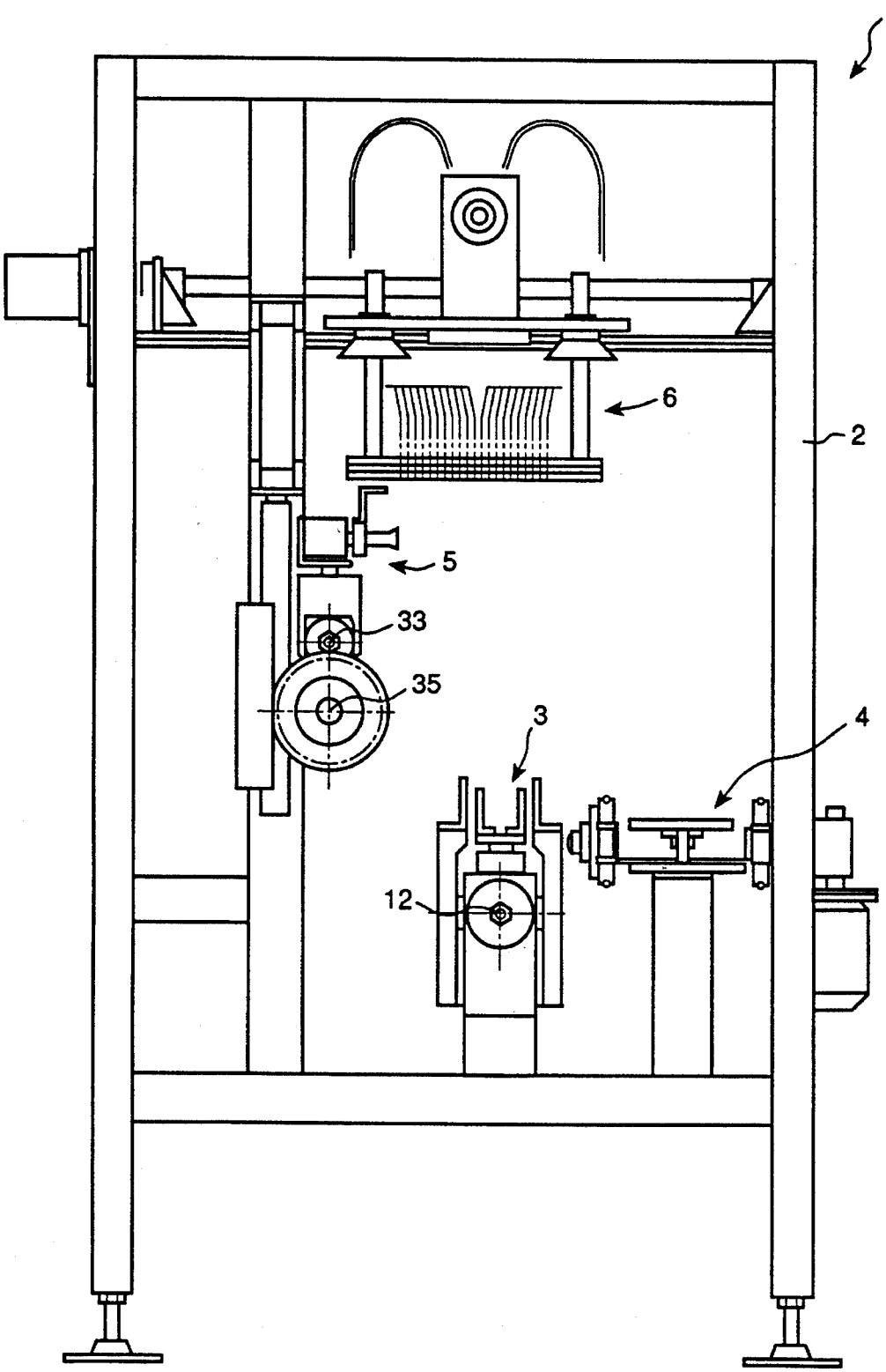
FIG. 2 is a front view of the machine.

With particular reference to the drawing figures and, in particular, first to FIGS. 1 and 2, the ampul boxing machine generally indicated with comprises a framework 2, an ampul conveyor device 3, a box transporting and positioning device 4, an ampul transfer device 5 and a device for transient ampul clamping 6.

Figure 3:
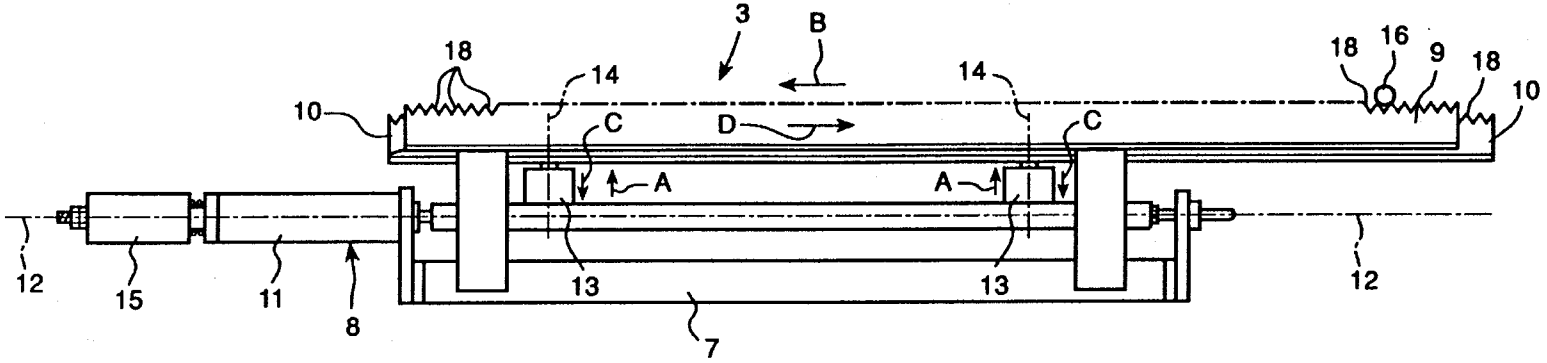
FIG. 3 is a side view of the ampul conveyor device.
Figure 4:
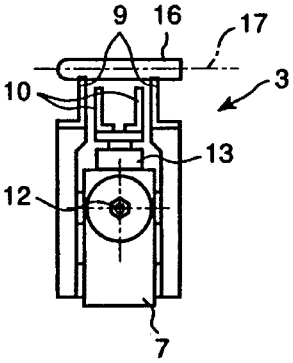
FIG. 4 is a front view of the ampul conveyor device.

Referring next to FIGS. 3 and 4, the ampul conveyor device 3 comprises a frame 7, actuator means 8, one pair of fixed rectilinear toothed devices 9 and one pair of mobile rectilinear toothed elements 10.

The frame 7 has a substantially "U" shape, is integral with the framework 2 of the boxing machine 1 and supports both the actuator means 8 and the pair of fixed toothed elements 9. The actuator means 8 (see FIGS. 3 and 4), comprise an actuator element 11 for the horizontal translation along an axis 12 and two actuator elements 13 (or at least one of them), for the vertical translation according to vertical axes 14. The actuator element 11 for the horizontal translation is associated with a stroke regulator 15 in order to enable the device 3 to be adapted for transporting ampuls with different diameters.

The actuator elements 13 for vertical translation support, at their ends, the pair of mobile toothed elements 10. The toothing of the fixed toothed elements 9 and mobile toothed elements 10 is identical and is such as to create indentations 18, preferably with "V" shape, in order to house ampuls 16, each centered on a respective axis 17 whose projection is perpendicular to axis 12. In their resting position, the pair of fixed toothed elements 9 is at a higher level than of the mobile toothed elements 10, and therefore the ampuls are located inside the indentations 18 provided by the first ones. The "V" shape of such indentations 18 makes it possible ampuls with different diameters to be housed and automatically centered.

During machine operation, the mobile toothed elements 10 are lifted according to the axes 14 (arrow A), owing to the action of the actuator elements 13, such that the bottoms of the mobile indentations reach a higher level than the tops of the fixed indentations. Subsequently, the mobile toothed elements 10 are horizontally shifted (Arrow B) by at least one pitch relatively to their toothing along the axis 12, by the action of the actuator element 11. When the horizontal shift is ended, the mobile toothed elements 10 are moved downwards (Arrow C) according to the axis 14, such that the tops of the mobile indentations reach a lower level than the bottom of the fixed indentations, thus depositing all of the ampuls into the indentations 18 of the fixed toothed elements 9 after being advanced by at least one toothing pitch. The actuator element 11 is now started up and brings the mobile toothed elements 10 back to their respective starting positions, by means of a horizontal translation according to the axis 12 in reversed direction relative to the preceding ones, i.e., contrary to the direction of advancement (arrow D). Such cycles follow each other, causing the advancement of ampuls, with continuity.

The ampuls 16 are charged to the device 3 at the indentations 18 placed at the right-hand end (looking at FIG. 3) of the conveyor device 3. At that end, also means are provided in order to detect the presence of ampuls 18 inside the indentations. Such means preferably comprise a photocell, not illustrated, which ensures that the device 3 will operate and consequently advance the ampuls already charged to it, only in the event when the filling of the indentations provided at the right-hand end has taken place. In such a way, the certainty is obtained that the loading of ampuls 16 onto the conveyor device 3, although carried out by any means, and, possibly, also using per se known means, has actually taken place. Therefore, during this initial step of the boxing cycle, the ampul rows are already complete.

Any ampuls which may arrive broken to the conveyor device 3, are automatically removed by gravity, falling down through the hollow existing between the toothed elements 9 and 10, and are soon replaced by the successive ampuls arriving from the device, which remains stationary until the photocell has detected the presence of an ampul on the outermost indentation.

Figure 5:
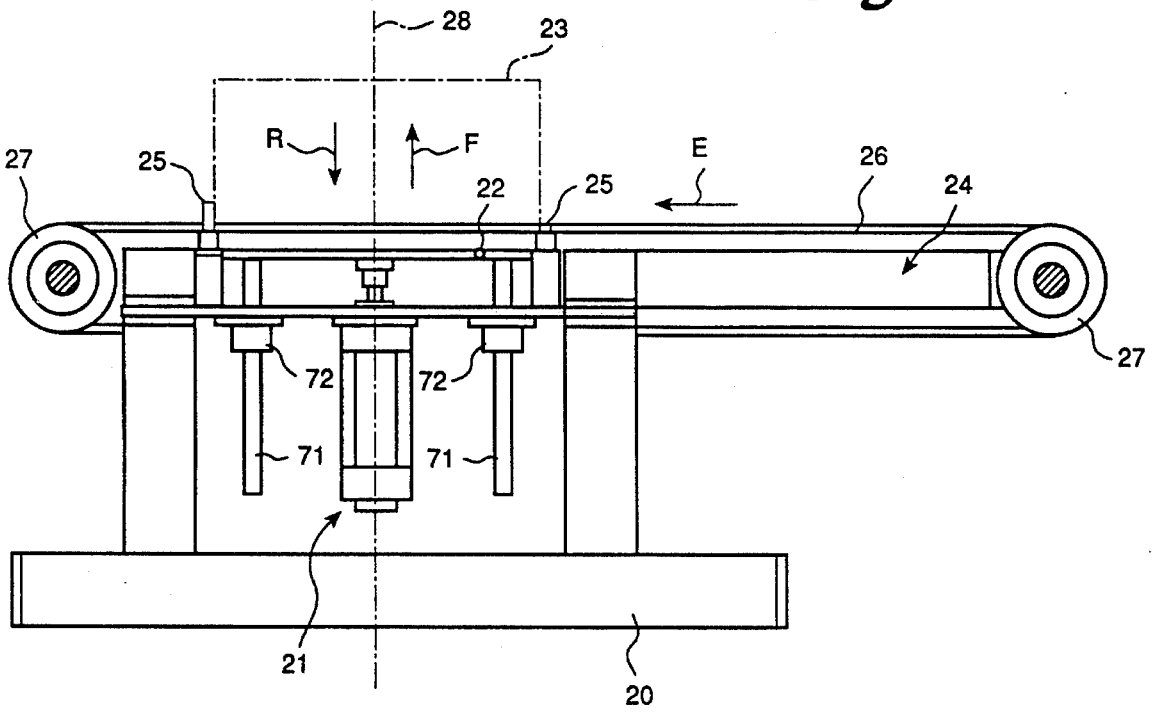
FIG. 5 is a side view of the box transporting and positioning device.
Figure 6:
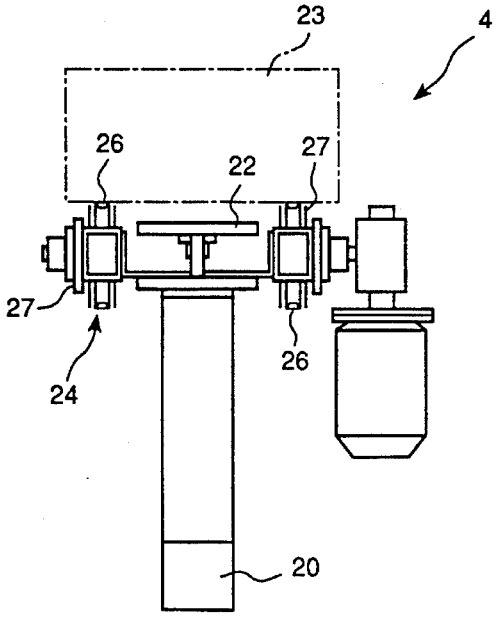
FIG. 6 is a front view of the box transporting and positioning device.

The box transporting and positioning device 4 (see FIGS. 5 and 6), comprises a frame 20, a lifting element 21, a support plane 22 for supporting a box 23, a belt conveyor 24 and at least one stop device 25. The frame 20 is integral with the framework 2 of the boxing machine 1, The lifting element 21 preferably is an either pneumatic or hydraulic cylinder integral with the frame 20 and acting at the barycentre of the support plane 22.

According to an alternative embodiment, the lifting element 21 may comprise rack means which are characterized by their action reliability and speed.

The support plane 22 is installed inside the free space defined by two belts 26 of the conveyor 24, which are taut on respective pairs of end pulleys 27. During its lifting movement, said support plane is guided, relative to the frame 20, by means of guides 71 and counter-guides 72.

The stop device 25 preferably comprises a pin integral with the frame 20 and protruding upwards relative to both the support plane 22 and the belts 26. The stop device 25 may be integrated by optional side guide means, not illustrated for the sake of precise as simplicity, in order to realize an as possible positioning of the box 23 on the support plane 22, in view of the subsequent filling step disclosed hereinafter.

The stop device, and, in particular, the pin 25, may be of retractible type in order to enable the box 23 to further translate in order to be discharged after being filled with ampuls, as is better explained in the following.

During the operation of the transporting and positioning device 4, a box 23 is loaded by means of known means, or manually, onto the pair of belts 26. The upper stretches of the pair of belts 26 run in the direction of arrow E, i.e., parallel to axis 12. The box 23 translates until it is stopped against the stop device 25, so centered that its bottom will hang over the center of the support plane and parallel to it. Owing to the action of the element 21, the support plane 22 is now vertically moved upwards according to the axis 28 (arrow F), by being guided by guides 71 and counter-guides 72, bringing the box to such a position as to be capable of receiving the ampuls temporarily clamped by the ampul clamping device 6, as is better explained in the following.

The box transporting and positioning device 4 may be associated with a device (not depicted) for opening the flanges of the boxes, in the event the latter are of the type with flanges.

The ampul transfer device 5 (reference is made in particular to FIGS. 7 and 8) is integral with the structure 2 of the machine, and is installed under the device 6 for transient ampul clamping and above the ampul conveyor device 3. In other terms, the ampul transfer device 5 is operatively installed between the ampul conveyor device 3 and the device 6 for transient ampul clamping.

Figure 7:
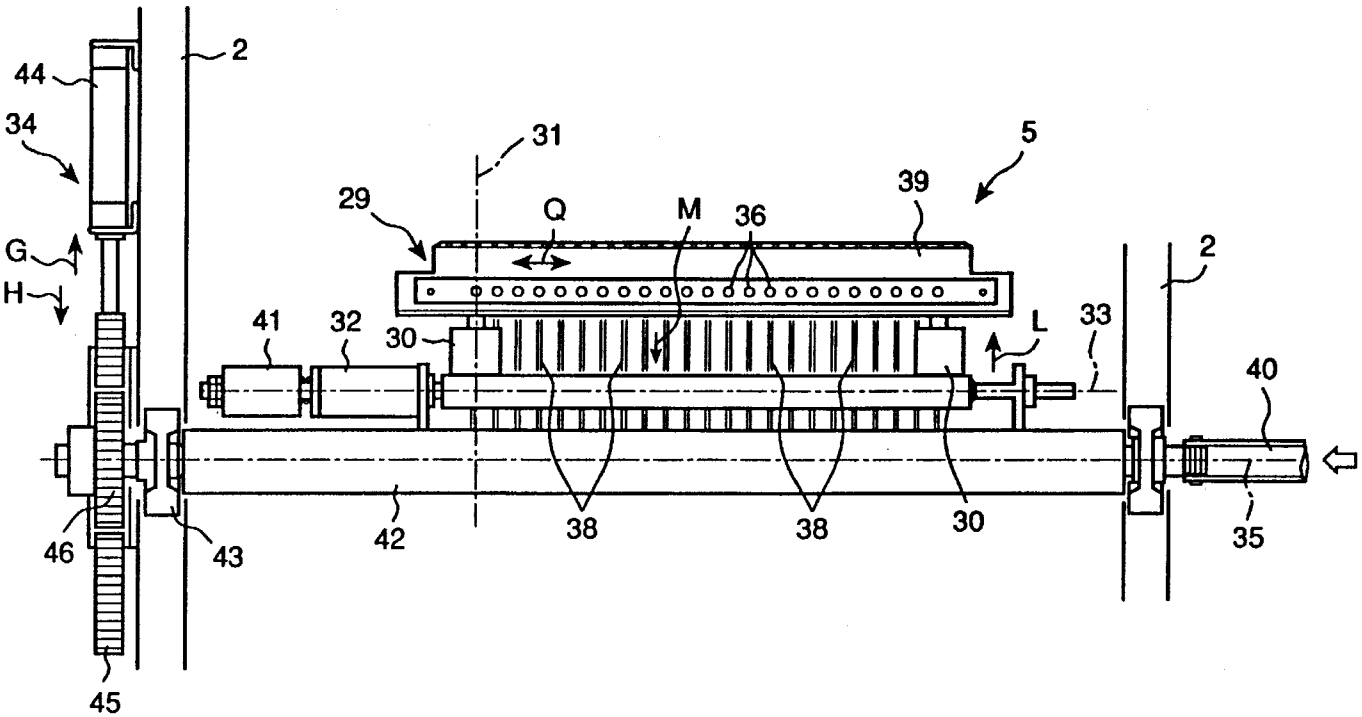
FIG. 7 is a side view of the ampul transfer device.

The ampul transfer device 5 (see FIGS. 7 and substantially comprises a suction device 29, first actuator means 30 for (vertical) translation according to axes 31, second actuator means 32 for (horizontal) translation according to axis 33, and third actuator means 34 for revolution around the horizontal axis 35, which is parallel to both axes 12 and 33. All of the actuator means 30, 32, 34 operate, either directly or indirectly, onto the suction device 29. Such a device comprises an aligned set of suction cups 36 connected by means of first single ducts 38 with a tubular element 42 which, through a subsequent single duct 40, is connected with a vacuum pump 37 (see FIG. 1). The tubular element 42 is supported at its ends by bearings 43 constrained to the structure 2. The suction cups 36 are associated with a toothed element 39 which cooperates order to keep the ampuls 16 correctly constrained their expected position. The first actuator means 30 directly act on the suction cups 36, in order to move them along the axes 31. The second actuator means 32 operate associated with a stroke regulator 41 and are structurally identical to those associated with the actuator means 8 of the device 3.

Figure 8:
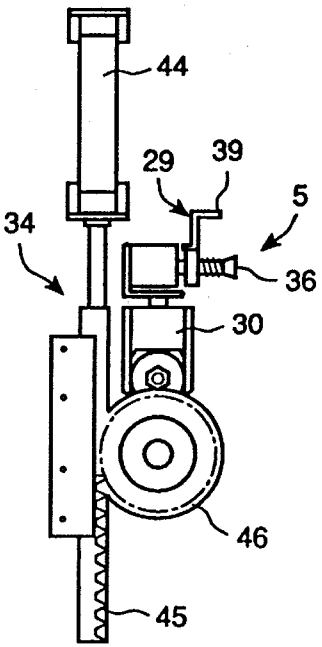
FIG. 8 is a front view of the ampul transfer device.

The third actuator means 34 comprise, in the herein exemplified case, a pneumatic piston 44, a rack 45 and a gear wheel 46 keyed to an end of the tubular element 42. Under rest conditions, the ampul transfer device 5 is in the position which is illustrated in FIGS. 7, 8 and 1. The suction cups 36 are arranged according to a horizontal axis, the projections of which on axes 33 and 35 are perpendicular to said axes.

At operation time, i.e., when an aligned ampul group 16 must be collected, the third actuator means 34 are started up, arrow G, causing the tubular element 42 to revolve around the axis 35. Consequently, the suction cups 36 of the suction device 29 translate along a circular trajectory the center of which lies on the axis 35, until the suction cups meet the ampuls 16 which are in waiting position, aligned inside the indentations 18 of the conveyor device 4. Each suction cup 36 "grips", i.e., attaches by suction, an ampul 16 at the cylindrical body thereof. The third actuator means 34 are started up in the contrary direction to the above (arrow H), causing the suction cups 36 of the suction device 29 to return back to their starting positions, however retaining the ampuls 16 arranged according to a vertical axis the projection of which is perpendicular to axes 33, 35 and 12. The first actuator means 30 vertically lift (arrow L) the suction cups 36 of the suction device 29. The ampuls are transferred to the overhanging device 6, totally filling a row of seats provided on the latter. The actuator means 30 reverse their movement direction (arrow M), and the device 5 returns back to its initial position. In the case when a quincunx arrangement of the ampuls 16, or of the various ampul rows, is provided in the device 6 for transient clamping, the second actuator means 32 move the ampuls 36 by one step, parallel to the axis 33, before the ampuls are transferred to the transient ampul clamping device 6 (arrow Q).

Figure 9:
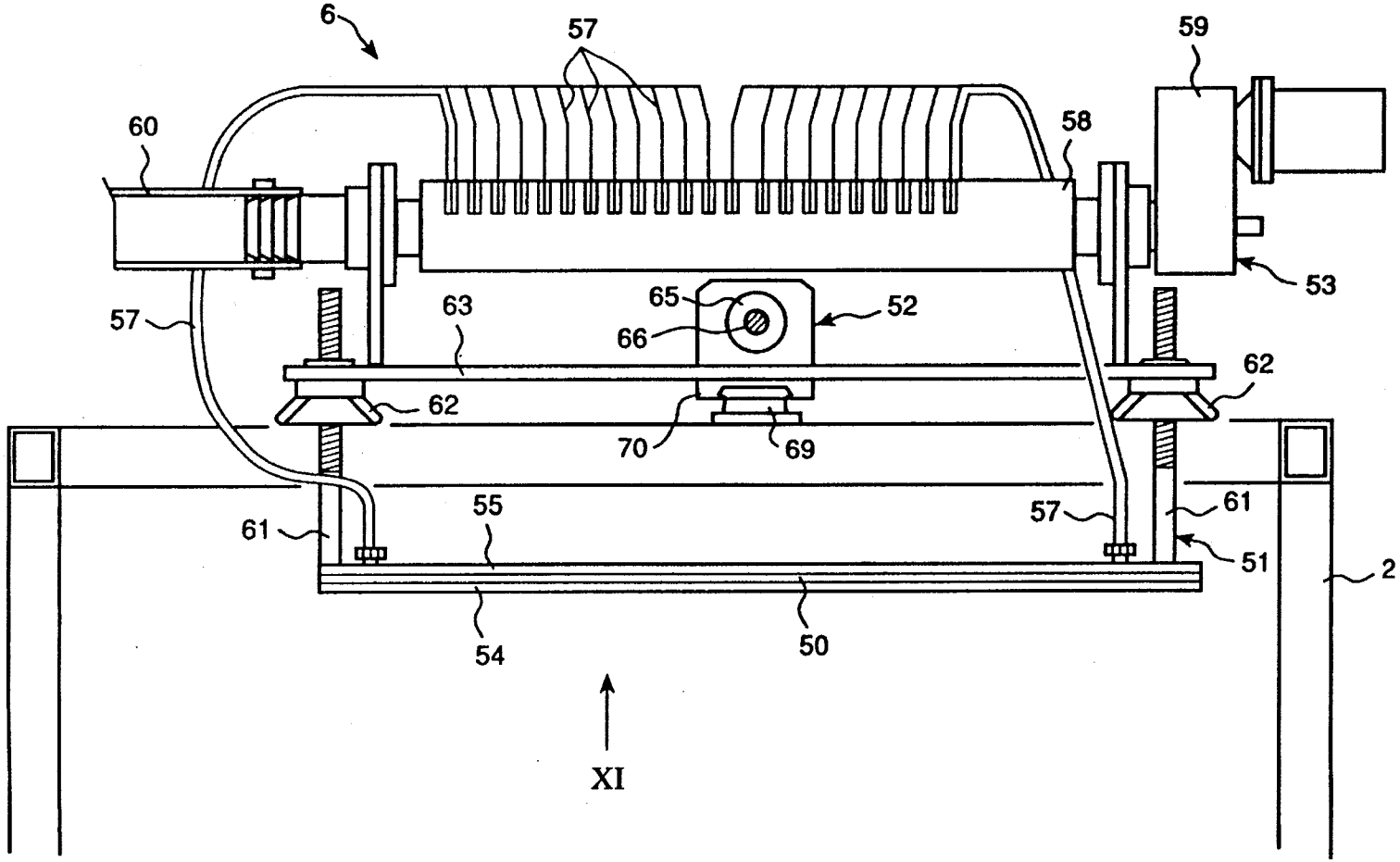
FIG. 9 is a side view of the device for transient ampul clamping.
Figure 10:
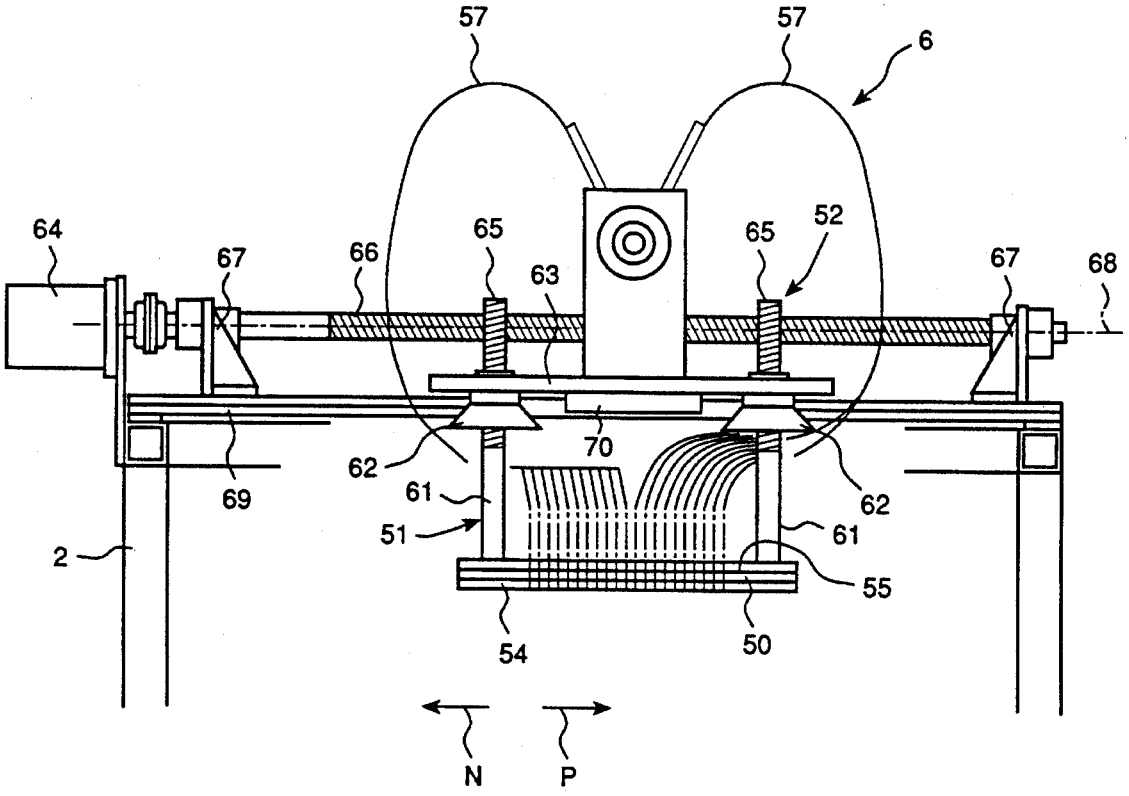
FIG. 10 is a front view of the transient ampul clamping.
Figure 11:
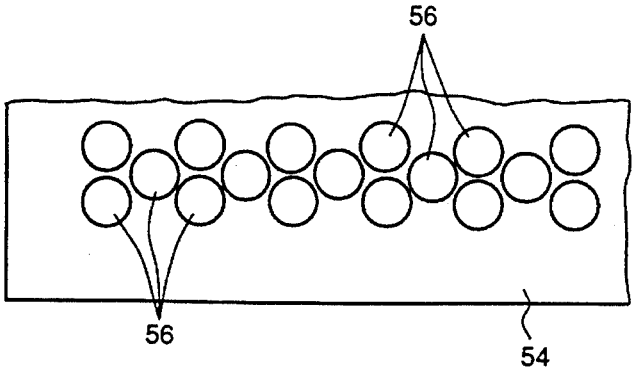
FIG. 11 is a schematic view according to the Arrow XI of FIG. 9.

The transient ampul clamping device 6, see FIGS. 9–11, comprises an ampul clamping head 50, a device 51 for the adjustment of vertical position of the head, a device 52 for horizontally translating the head, and a suction device 53. The device 6 for transient ampul clamping is constrained to the framework 2 of the boxing machine 1 over the ampul translation device 5. The ampul clamping head 50 substantially comprises a first plate 54 and a second plate 55, connected with each other under tightly sealing conditions. The first plate 54 is provided with a plurality of rows of bores arranged according to a quincunx arrangement, in order to optimize the clamping surface of the same plate, and therefore in order to optimize the useful volume of the box to be filled. Between the plates, suction ducts, not visible, are provided, each acting on one single row of bores 56 and connected through flexible piping 57 with a distributor 58 of the suction device 53. The suction device 53 comprises the distributor 58, the pipes 57, a device 59 for actuating the distributor 58 as a function of the pipe(s) 57 to be fed, and a third pipe 60 for connecting the distributor with the vacuum pump 37, visible in FIG. 1. The device for vertical position adjustment 51 comprises mutually opposite pairs of screws 61 and knobs 62. The screws are integral with the plates 55 and 54, and the knobs 62 idly revolve integral with a third plate 63 integral, in turn, with the nut screws 65.

By rotating the knobs 62 in either direction, or in the opposite direction, the plates 54 and 55 can be lifted or moved downwards. Such an adjustment is necessary when adapting the device 6 in order to operate on ampuls with different sizes is desired, and therefore, when size is being changed should, be carried out before starting a boxing cycle.

The horizontal translation device 52 substantially comprises a stepper motor 64, a screw 66 and at least one nut screw 65, a guide 69 and a counter-guide 70. The motor 64 and the guide 69 are integral with the framework 2 and the counter-guide 70 and the nut screw 65 are integral with the third plate 63. The screw 66 revolves around its own axis 68, supported at its ends, by supports 67 integral with the guide 69 and therefore with the framework 2 of the boxing machine. By actuating the motor 64 in either direction, or in the opposite direction, the suction device 53 and the ampul clamping head 50 are moved in a direction or in the opposite direction, arrows N and P, parallely to axis 68, the position of which is perpendicular to the axis 12 along which the ampuls 16 advance.

In the case exemplified herein, the ampul clamping head 50 has a rectangular shape in plan view, because it is destined to fill a rectangular box with the bottom of the box being of the same shape and size thereof. By changing the shape and the size of the ampul clamping head 50, however, also boxes having correspondingly different shapes and sizes in plan view, are also possible. For example, one might also think of the boxing machine 1 being also capable of filling boxes of square or circular shape by means of ampuls preferably arranged in quincunx arrangement. The boxing machine is hence also flexible in use.

The operating way of the boxing machine 1 as whole is as follows.

The ampuls 16 are continuously charged to the conveyor device 3 at the right-hand end of FIG. 3, by using known means. Each ampul advances along the device 3, by being submitted to a cyclic movement which comprises, for each shift from an indentation 18 to the successive indentation: a vertical movement upwards, Arrow A; a horizontal shift in advancement direction, Arrow B; and a vertical translation downwards, Arrow C. In other terms, each ampul is moved perpendicularly to its own axis 17, parallel to axis 12. When a group of ampuls 16, in a same number as of the suction cups 36, is aligned on the device 3 in the region of influence of the ampul transfer device 5, the latter is enabled. By being revolved around the axis 35 of the tubular element 42, the suction cups 36 come into contact with the ampuls 16 which are lying with their axis 17 being horizontally arranged. The ampuls are sucked by suction by the suction cups 36 and translated along a circular trajectory until they reach such a position that their vertical axes pass through the centers of the bores 56 provided through the plate 54. The actuation of the actuator elements 13 upwards, arrow F, causes the upper end of the ampuls 16 to enter a row of bores where they are retained by suction owing to the actuation of the distributor 58 which has previously connected with the suction line the only relevant row of interested bores. Subsequently, the distributor 58 progressively connects with the suction line the rows of bores 56 which are engaged by the ampuls, with simultaneously keeping active the already engaged rows.

When the ampuls 16 are inserted, the suction action by the suction cups 36 of the transfer device 5 ends. The motor 64 is enabled, causing the ampul clamping head 50 to advance by one step, so as to offer a next row of bores 56 ready to receive the subsequent row of ampuls 16. Inasmuch as such a bore row is arranged in quincunx arrangement relative to the preceding one, in order that the axes of the ampuls may coincide with the centers of the bores, a horizontal shift by one step is necessary, which is supplied to the ampuls by means of the second actuator means 32, arrow Q. When all the rows of bores 56 of the plate 54 are occupied by the ampuls 16, the ampul clamping head 50 substantially is on the perpendicular of the box transport and positioning device 4 and vertically under a relevant box 23 transported to the correct position by the pair of belts 26, and stopped by the pin 25. The support plane 22 is moved vertically upwards, arrow F, until the ampuls retained by the ampul clamping head 50 come to stand inside the interior of the box 23. The device 53 is switched off and the ampuls 16 are left inside the interior of the box 23 arranged in quincunx arrangement, so as to take the maximal advantage of the available room. The support plane 22 is lowered (arrow R), and the by now filled box 23 comes to rest on the pair of belts 26. The pin 25 is retracted. The pair of belts is actuated and conveys the box to leave the boxing machine (arrow E), ready to be closed and sealed by means of wrapping and heat-shrinking, as well as proper labelling, devices.

The operating steps of the boxing machine 1 and of the subsequent machines are scheduled according to the pre-established sequence by means of a computer-supported unit, not illustrated for the sake of simplicity, which can be so programmed as to take into account any changes in size of ampuls, of the head 50 and, obviously of the boxes to be filled.

During tests and experiments, it was observed that the device 6 for transient ampul clamping, which is of pneumatic type, may operate incorrectly in those cases when, for any reason, one ampul leaves one of the bores 56, or undergoes breakage inside it.

In such a case, directly through the bore 56, communicating with the outside, the suction action is prevailingly discharged, which normally is equally subdivided between all of the bores 56 of a same row, and therefore uniformly acts on all of the relevant ampuls which occupy them.

As a consequence, a decrease in clamping action on the ampuls which occupy the bores of the corresponding row occurs. That sometimes may lead to the loss of other ampuls (usually, those ampuls which are the closest to the ampul lacking bore 56), with consequently a further decrease occurring in the suction action throughout the involved row and the relevant ampuls progressively falling down.

In order to obviate such a drawback, one might certainly think of providing a suction force which is more intense than as strictly necessary in order to keep the ampuls clamped; however, such a value cannot exceed certain limits, in order to prevent other negative phenomena from arising.

For high depressure values, the device 6 for transient ampul clamping loses its characteristic of "smoothly" sucking and subsequently retaining the ampuls.

Figure 12:
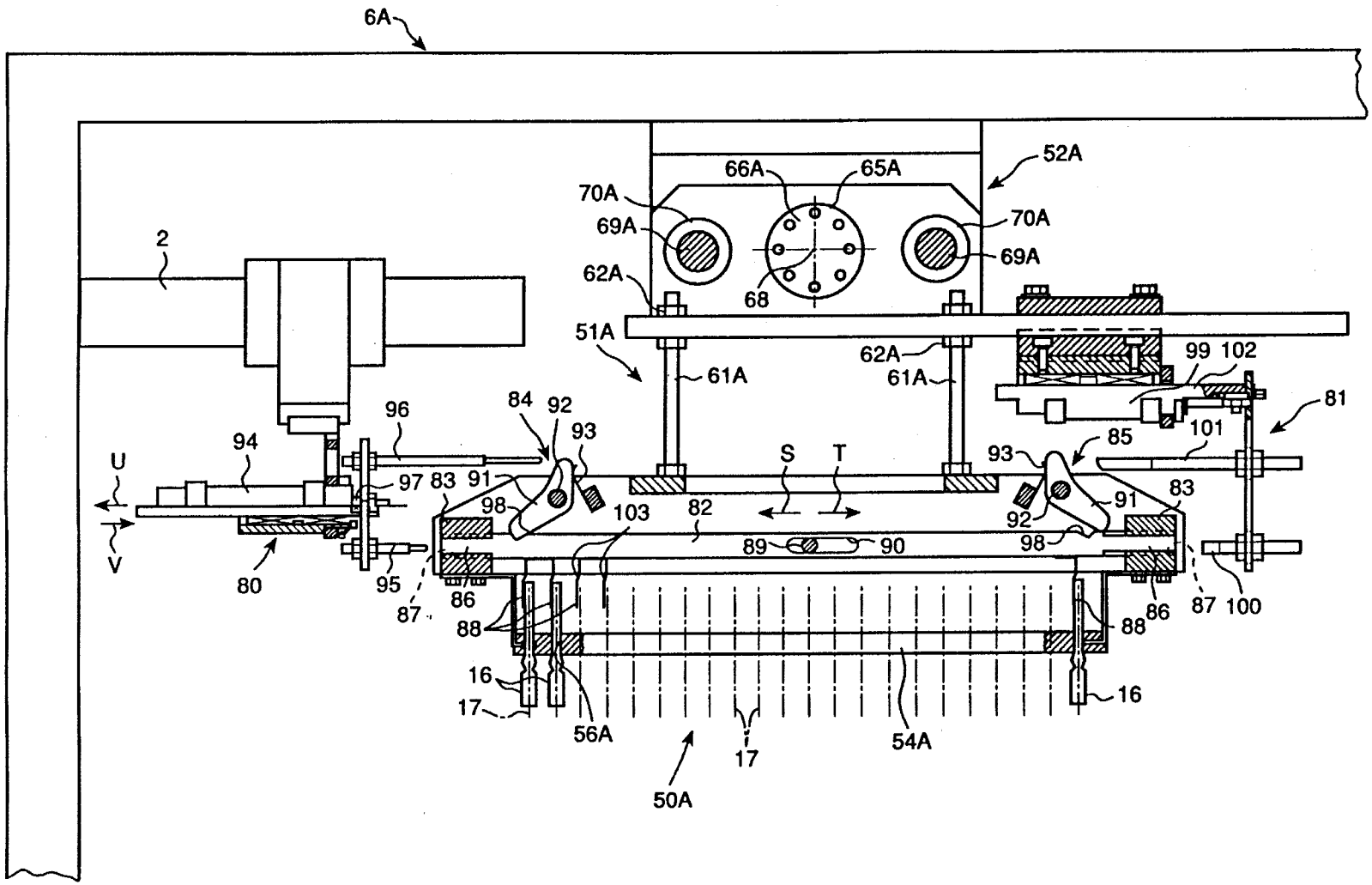
FIG. 12 is a side view of the device for transient ampul clamping according to a second embodiment of the invention, and relevant devices.
Figure 13:
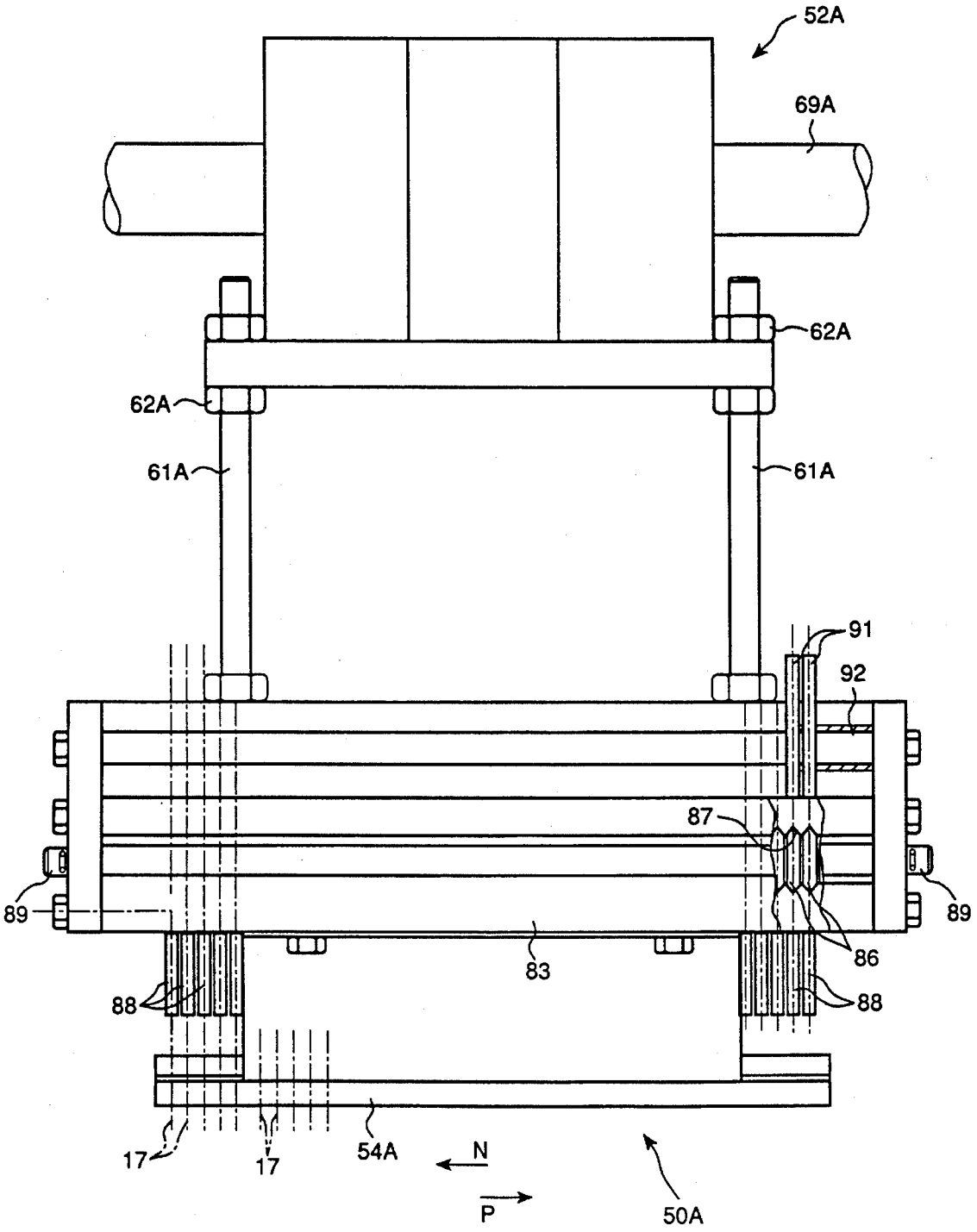
FIG. 13 is a front view of the device for transient ampul clamping, according to the second embodiment of the invention, and relevant devices.

However, in order to obviate the drawbacks the device 6 of pneumatic type is replaceable by, as shown in FIGS. 12–13, a mechanical device 6A for transient ampul clamping.

In such a device 6A, the corresponding elements to the elements of device 6 are indicated with the same reference numeral, however with an additional "A" suffix.

Such a device comprises an ampul clamping head 50A, a vertical position adjustment device 51A, a device for horizontal translation 52A, a locking actuator device 80 and an unlocking actuator device 81.

The ampul clamping head 50A substantially comprises a first plate 54A, a set of crosspieces 82, a set of beams 83, a first stop device 84 and a second stop device 85.

The first plate 54A is provided with bores 56A preferably arranged in quincunx arrangement, through which ampuls 16 are slid by the underlying ampul 16 transfer device 5. The crosspieces 82 have ends 86 with polygonal, however not circular, and preferably hexagonal, shape, suitable for sliding without revolving around their respective longitudinal axes, according to the arrows "S" and "T" inside the interiors of seats 87 provided on the beams 83.

For better clarity, when the device 6A is mounted on the boxing machine 1 instead of the device 6, such a sliding movement "S" takes place parallel to the horizontal axes 12 and 35, and perpendicular to the axis 68.

On each crosspiece 82, opposite to the bores 56A flexible clamping flat springs 88 are provided, which are suitable for engaging the ampuls 16.

Each of the crosspieces 82 is centrally provided with a respective elongated opening 90 through which, owing to mechanical reasons, a stationary pin 89 runs.

The first stop device 84 and the second stop device 85 are equal to each other. Each of them comprises a pawl 91 revolving relative to a pin 92 and an elastic element constituted by a flat spring 93, as well as a groove 98 provided at the end of the crosspiece 82 with which both devices 84 and 85 are associated. In other terms, on each crosspiece 82 both a first stop device 84 and a second stop device 85 are active.

The vertical position adjustment device 51A comprises, analogously to the device 51, mutually opposite pairs of screws 61A and adjustment knobs or nuts 62A. By varying the position of the nuts 62A along the screws 61A, the vertical position of the ampul clamping head 50A can be changed.

The device for horizontal translation 52A comprises, analogously to the device 51, a stepper motor (not visible in figures), a screw 66A, a nut screw 65A, guides 69A and counter-guides 70A, The screw 66A revolving owing to the action of the stepper motor causes the head 50A to slide along the guides 69A, the counter-guides 70A, and consequently to advance in the direction of the arrows N or P, usually by one step each time, in order to enable a new row of empty bores 56A to be positioned opposite to the underlying ampul transfer device 5.

The locking actuator device 80 substantially comprises an actuator element 94 which may be of either hydraulic or pneumatic type, a first presser element 95 and a second presser element 96.

The locking actuator device 80 is constrained to the framework 2 of the boxing machine 1.

The first presser element 95 and the second presser element 96 are moved by a stem 97 of the actuator element 94 parallel to the horizontal axes 12 and 33, perpendicularly to the axis 68 (arrows "U", "V"). The first presser element 95 acts on the end 86 of the crosspiece 82 which is opposite to it, while the second presser element 94 acts on the pawl 91 of the corresponding first stop device 84.

The length of the presser elements 95 and 96 is so calculated that the first presser element 95 may act on the relevant crosspiece end 86 only after the second presser element 96 has caused the pawl 91 to rotate around the pin 92 to a sufficient extent in order to disengage it from the groove 98.

The unlocking actuator device 81, which, on the contrary, is integral with the head 50A, comprises, analogously to the locking actuator device 80, an actuator element 99, a first presser element 100 and a second presser element 101.

Both the presser elements 100 and 101 are moved by the stem 102 of the actuator element 99 according to arrows U and V.

In this case too, the presser elements 100 and 101 have such a length as to respectively act, and with the same timing modalities as of the corresponding elements 95 and 96, on the crosspiece ends 86 and on the pawls 91; however, such elements 100 and 101 substantially are short rods parallel to beams 83.

In such a way, the second element 101 simultaneously engages all of the pawls 91, and the first element 100 simultaneously engages all crosspieces 82 ends 86.

During the operation of the boxing machine, the rows of ampuls 16 are progressively slid by the transfer device 5 into the bores 56A, owing to the effect of the translation of the head 50A caused by the means 52A for horizontal translation.

The clamping flat springs 88 of the crosspieces are in the position as illustrated in FIG. 12, i.e., shifted in the direction of the arrow N, in order not to collide with the top portion of the ampul which is being slid into.

When the sliding of the row of ampuls 16 into the corresponding bores is complete and while the device 5 continues to support the inserted ampuls, the locking actuator device 80 is started up and causes the presser elements 95 and 96 to translate in the direction as of the arrow V. The second presser element 96 acts on the pawl 91, disengaging it from the groove 98. With the advancement in the direction of arrow "V" continuing, the first presser element acts on the crosspiece end 86 opposite to it and pushes the relevant crosspiece 82 to move in the same direction, causing all of the ampuls 16 of the row to get locked inside the interior of the bores 56A owing to the spring action exerted by the clamping flat springs 88, which are further bent.

The translation movement of the crosspiece 82 continues until the pawl 91 opposite to the inserted pawl snaps into its locking position, getting engaged with the groove 98, and blocks in locked position the crosspiece 82.

The ampuls 16 of the row are hence clamped inside the interior of the bores 56A by an elastic force perpendicular to their respective longitudinal axes, exerted by the flat springs 88.

As one may observe from the drawings, also under resting conditions, the flat springs 88 each display a bend 103 which facilitates their task.

In fact, such a bend prevents, as far as possible, each flat spring 88 from pressing, owing to the effect of its bending, on one point only on the ampul 16, i.e., tangentially and at its top. Should such a situation arise, upon considering that each flat spring 88 is constrained to the crosspiece 82 above the same ampul, it would also apply a force component directed along the axis 17 of the ampul and directed towards the outside of the ampul clamping head 50A, i.e., downwards. Therefore, such a force would tend to expel the ampul 16, hindering the action of the friction forces acting at the interface between the surface of each ampul 16 and the surface of each bore 56A, which retain the ampuls inside said bores 56A.

When the ampul clamping head 50A is totally filled and is inside the interior of the box to be filled, the simultaneous disengagement of all of the ampuls takes place by actuating the unlocking actuator device 81 in the direction of the arrow U. Owing to the structure of the presser elements 100 and 101, all of the pawls 96 are actuated simultaneously and all the crosspieces 82 are translated in succession in the direction of arrow "U", until all the pawls 91 acting on the crosspiece ends 86 which are opposite to those ends on which the second stop device 85 acts, get engaged with the relevant grooves 98, locking the crosspieces 82 in their "open" position, thus releasing the ampuls 16, which are placed inside the interior of the packaging box.

Figure 14:
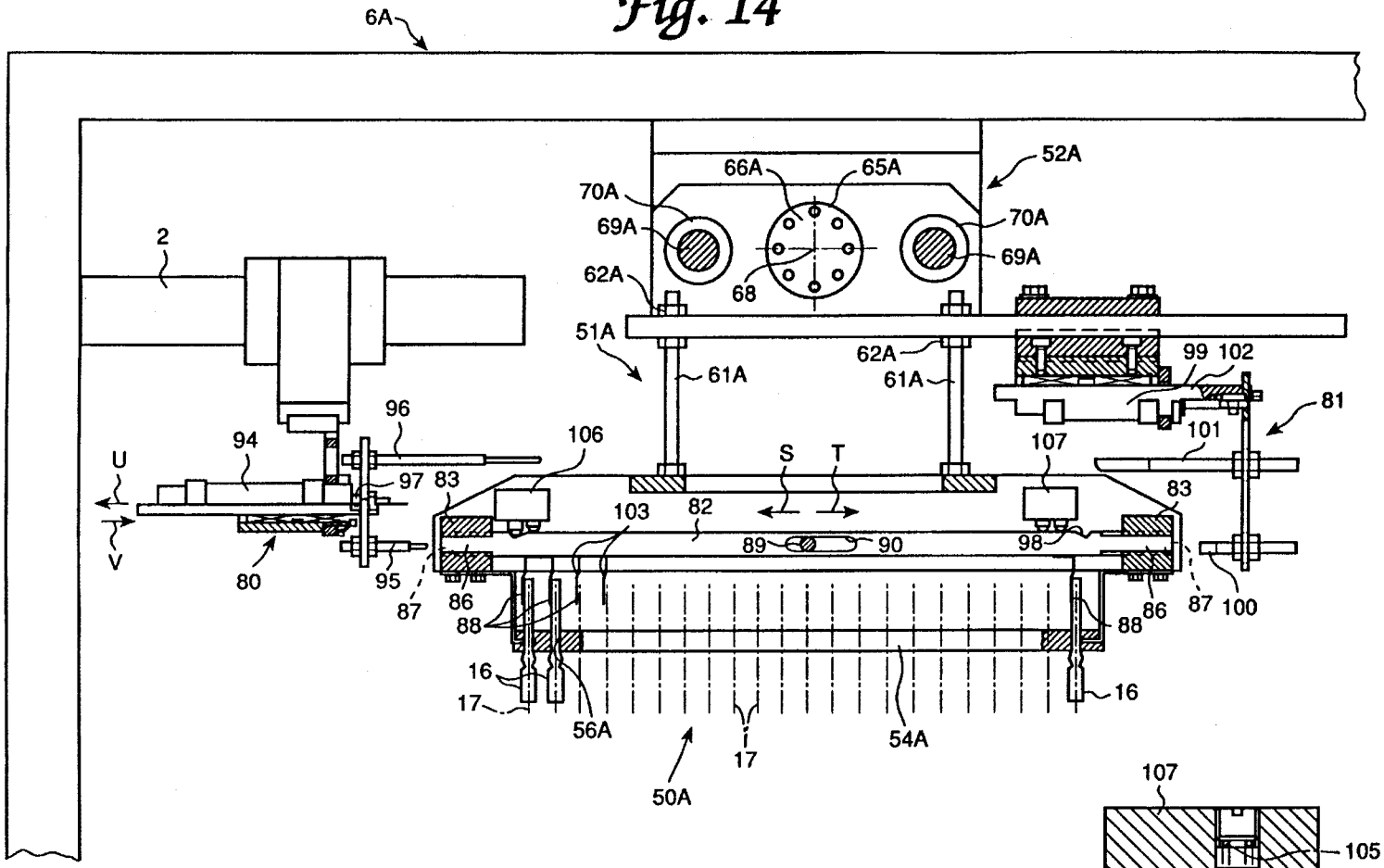
FIG. 14 illustrates a device for transient ampul clamping according to a third embodiment of the invention, which is different from the second embodiment as regards the structure of stop devices.
Figure 15:
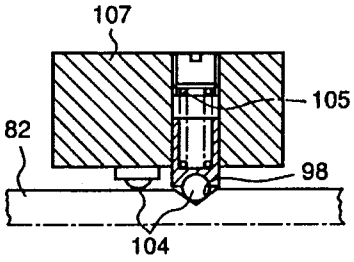
FIG. 15 is a detail of the stop device.

Referring in particular to FIGS. 14 and 15, the stop devices, which are indicated with the reference numerals 106 and 107, respectively, substantially comprise, for each crosspiece 82, a ball 104 destined to becoming engaged with the relevant groove 98, and pre-loaded by a spring 105.

By varying the pre-load of the spring 105 acting onto each ball 104, the resistance to device unlocking can be varied.

I claim:

1. A method for boxing medical-use glass ampuls each having a cylindrical wall portion having a given diameter, and a given length, comprising:

(a) operating a horizontally arranged walking beam-type ampul conveyor having a succession of vertically upwardly opening indentations for receiving respective recumbent ampuls, accumulating a complete recumbent row thereof and conveying that row to a first given location;

(b) operating an ampul transfer device comprising a row of suction-grippers and a support for:

(i) rotating the row of suction grippers together from a first position to a second position about a horizontal axis each into contact with said wall portion of a respective ampul at said given location, causing the row of ampuls to become suction-gripped by the suction grippers;

(ii) rotating the row of suction grippers together from said second position to a third position about said horizontal axis to verticality; and (iii) vertically raising the row of suction grippers together from said third position to a fourth position, to a second given location;

delivering suction to said suction-grippers during (b)(i), until (b)(iii) has been accomplished and then releasing said suction;

(c) operating a transient ampul clamping device comprising a horizontally arranged plate having a plurality of rows of vertically downwardly opening apertures provided therein, each served by a respective ampul releasable gripper, said rows of apertures in said plate each being parallel to said row of suction grippers for indexing said plate means in a horizontal direction for successively disposing each of said rows of apertures in vertical registry with respective ones of said suction grippers such that as said support for said suction grippers raises from said third position to said fourth position, an upper end portion of each ampul gripped by a suction-gripper is thrust relatively upwardly into a respective said aperture, whereby, by successive operations, each said aperture receives a respective ampul upper end portion and said plate has become disposed in a third given location;

activating said releasable grippers to releasably retain each row of ampul upper end portions in a respective row of apertures;

(d) operating a box transport and positioning device for accepting an upwardly opening box, positioning the box at a fourth given location which is in vertical registration under said plate at said third given location, lifting said box to enclose all of said rows of ampuls supported by said plate means disposed in said third given location, lowering said box to said fourth given location, and transporting said box beyond said fourth given location;

deactivating said releasable grippers while said box is elevated in enclosing relation to all of said rows of ampuls, for thereby releasing said ampuls into said box, so that as said box is lowered to said fourth given location, said box contains all of said rows of ampuls.

2. A machine for boxing medical-use glass ampuls each having a cylindrical wall portion having a given diameter, and a given length, comprising:

(a) a horizontally arranged walking beam-type ampul conveyor having a succession of vertically upwardly opening indentations for receiving respective recumbent ampuls, accumulating a complete recumbent row thereof and conveying that row to a first given location;

(b) an ampul transfer device comprising a row of suction-grippers and a support for:

(i) rotating the row of suction grippers together from a first position to a second position about a horizontal axis each into contact with said wall portion of a respective ampul at said given location, causing the row of ampuls to become suction-gripped by the suction grippers;

(ii) rotating the row of suction grippers together from said second position to a third position about said horizontal axis to verticality; and (iii) vertically raising the row of suction grippers together from said third position to a fourth position, to a second given location;

said ampul transfer device further including means for delivering suction to said suction-grippers during (b)(i), until (b)(iii) has been accomplished and then releasing said suction;

(c) a transient ampul clamping device comprising a horizontally arranged plate means having a plurality of rows of vertically downwardly opening apertures provided therein, each served by a respective ampul releasable gripper, said rows of apertures in said plate means each being parallel to said row of suction grippers;

said transient ampul clamping device further comprising a support for indexing said plate means in a horizontal direction for successively disposing each of said rows of apertures in vertical registry with respective ones of said suction grippers such that as said support for said suction grippers raises from said third position to said fourth position, an upper end portion of each ampul gripped by a suction-gripper is thrust relatively upwardly into a respective said aperture, whereby, by successive operations, each said aperture receives a respective ampul upper end portion and said plate means has become disposed in a third given location;

said transient ampul clamping device further including means for activating said releasable grippers to releasably retain each row of ampul upper end portions in a respective row of apertures;

(d) a box transport and positioning device for accepting an upwardly opening box, positioning the box at a fourth given location which is in vertical registration under said plate means at said third given location, lifting said box to enclose all of said rows of ampuls supported by said plate means disposed in said third given location, lowering said box to said fourth given location, and transporting said box beyond said fourth given location;

said transient ampul clamping device further including means for deactivating said releasable grippers while said box is elevated in enclosing relation to all of said rows of ampuls, for thereby releasing said ampuls into said box, so that as said box is lowered to said fourth given location, said box contains all of said rows of ampuls.

3. The machine of claim 2, wherein:

each of said upwardly opening indentations is V-shaped.

4. The machine of claim 2, wherein:

said ampuls conveyor further includes a stroke regulator which is adjustable for accommodating cycling of said ampul conveyor to boxing of ampuls of differing given diameter.

5. The machine of claim 2, wherein:

said ampul transfer device further includes a stroke regulator which is adjustable for accommodating cycling of said ampul transfer device to boxing of ampuls of differing given diameter.

6. The machine of claim 2, wherein:

said ampul transfer device further includes a toothed element supported in juxtaposition with said row of suction-grippers for engagement with respective ampuls when suction gripped by said suction-grippers, for maintaining alignment of the respective said ampuls in a respective row.

7. The machine of claim 2, wherein:

said rows of downwardly opening apertures in said plate means are disposed in a quincunx pattern.

8. The machine of claim 2, wherein:

said releasable grippers of said transient ampul clamping device comprise respective elastic flat springs arranged to releasably engage respective ampuls within respective said apertures.

* * * * *